United States Patent [19]

Peck

[11] Patent Number: 4,926,835

[45] Date of Patent: May 22, 1990

[54] BALL BEARING TYPE BOW STRING RELEASE

[75] Inventor: Paul L. Peck, Fond du Lac, Wis.

[73] Assignee: Archery Designs, Inc., North Fond du Lac, Wis.

[21] Appl. No.: 362,882

[22] Filed: Jun. 7, 1989

[51] Int. Cl.[5] ..... F41B 5/00

[52] U.S. Cl. ..... 124/35.2; 124/35.1

[58] Field of Search ..... 124/35 A, 35 R

[56] References Cited

U.S. PATENT DOCUMENTS

| | | | |
|---|---|---|---|
| 4,257,386 | 3/1981 | Gazzara | 124/35 A |
| 4,403,594 | 9/1983 | Todd | 124/35 A |
| 4,476,845 | 10/1984 | Rickard | 124/35 A |
| 4,527,536 | 7/1985 | Smith | 124/35 A |
| 4,620,523 | 11/1986 | Peck | 124/35 A |
| 4,674,469 | 6/1987 | Peck | 124/35 A |
| 4,691,683 | 9/1987 | Peck | 124/35 A |

*Primary Examiner*—Dennis L. Taylor
*Assistant Examiner*—John A. Ricci
*Attorney, Agent, or Firm*—Bayard H. Michael

[57] ABSTRACT

A bow string release has a head rotatably mounted on a guide sleeve fixed in the release handle. A bow string is held in a notch in the head by opposed balls mounted in a bore transverse to the notch and held in contact by control pins carried by a collar axially slideable on the head. The pin is connected to the collar and is actuated by a trigger pivoted in the handle to move the collar and the control pins to let the balls move apart to release the string. The trigger stroke is adjustable. The pin can rotate relative to the trigger and to the head.

9 Claims, 2 Drawing Sheets

BALL BEARING TYPE BOW STRING RELEASE

The object of this invention is to provide a ball bearing type bow string release which exerts balanced forces on the bow string and avoids imparting torque or lateral force to the string during release thereof.

BACKGROUND OF THE INVENTION

Many bow string releases found in the prior art retain the string in a notch by means of a finger or keeper closing the exit from the notch. Since this finger will become angled with respect to the bow string path as the bow string is released, it may exert a slight lateral force on the bow string which, to a skilled archer, will result in a less than perfect release. Release of this type are my Pat. Nos. 4,691,683, 4,620,523, 4,674,469 and Hamm Pat. No. 4,485,798.

Some bow string releases have utilized opposed fingers to retain the string. But, these fingers may impose lateral force during the release, or they can cause undue wear of the string. One such release is U.S. Pat. No. 4,257,386.

Pat. No. 4,403,594 shows a release utilizing balls which are held in contact with one another to retain the string in the string notch. A sleeve is used to hold the balls in contact. The release mechanism pulls that sleeve back to let the balls move radially outwardly to open up the throat of the release mechanism. This mechanism proves to be rather rough in operation and the pull characteristics are not suitable for skilled archers. The stroke of the release mechanism is not adjustable and the body can impose a twisting action on the string which in turn torques the string and adversely affects the shot.

The present design provides for a smooth release not torquing the bow string during the release or while the string is held by opposed balls. The string is retained in a head which can rotate relative to the release body and the archer's hand so that any unusual positioning of the hand will not reflect in twisting or torquing the string. The trigger stroke is adjustable and the present design additionally provides for optionally fixing the position of the body relative to the rotating head.

DETAILED DESCRIPTION OF THE DRAWINGS

Figure 1:
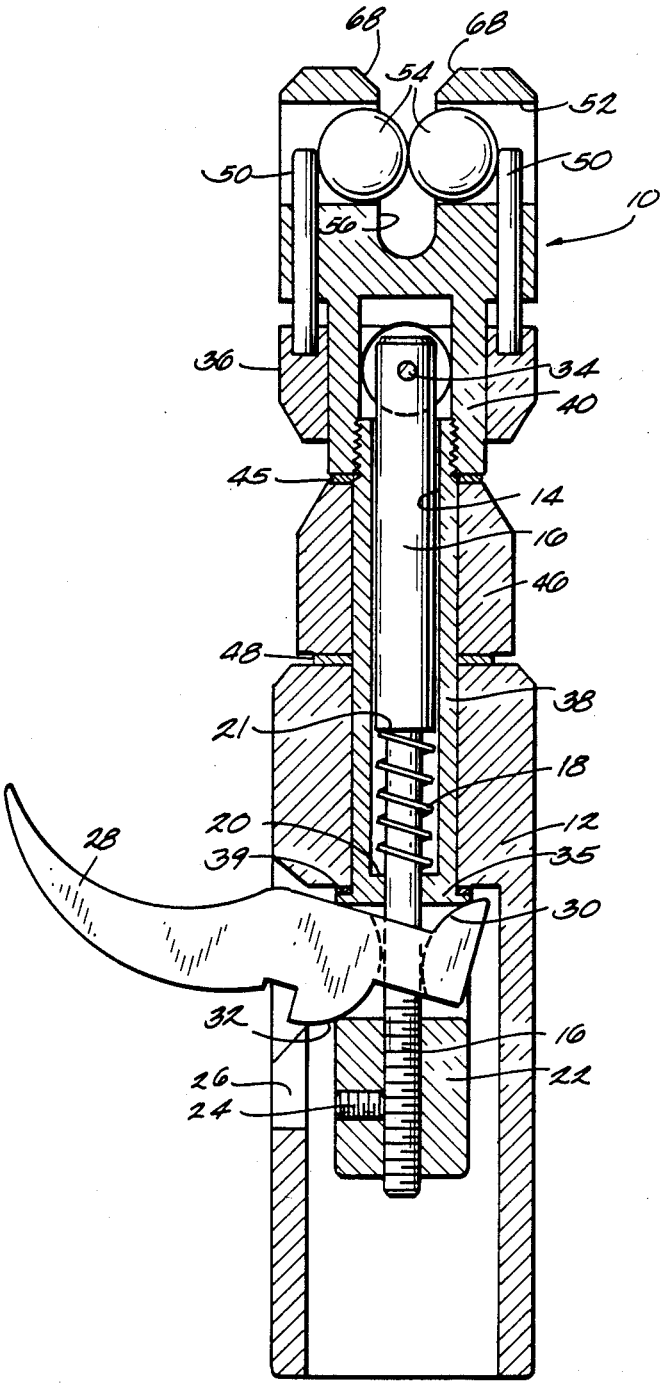
FIG. 1 is a vertical section through a release incorporating the present invention.

The ball bearing release illustrated in FIG. 1 is provided with a head 10 which rotates relative to the handle 12. The handle may be any of a number of configurations such as a finger grip or a concho type. A sleeve 38 interconnects the handle 12 and the head 10. Thus, the sleeve is mounted in a bore in the handle 12 and the shoulder 35 of the sleeve 38 engages the anti-friction washer 39 when the sleeve 38 is turned up tight in the skirt 40 of the head 10 with spacer 46 between the handle 12 and the head 10 and with antifriction washers 45 and 48 on either side of the spacer. The sleeve is not turned so tight as to overload and "freeze" the anti-friction washers 39, 45 and 48. This permits free rotation of the spacer relative to both the head and the handle and free rotation of the head relative to the handle.

Pull pin 16 is slidably mounted within the sleeve 38 and spring 18 is compressed between the inside shoulder 20 of the sleeve and the shoulder 21 on the pull pin to bias the pull pin upwardly in FIG. 1. Adjusting pad 22 is mounted on the threaded lower end of the pull pin. The adjusting pad is provided with a lock screw 24 which is accessible through the slot 26 in the handle. Trigger 28 is rockably mounted on the pull pin 16 and is provided with the cam surfaces 30, 32 which respectively engage the sleeve shoulder 35 on the interior of the handle and the pad 22. As the trigger is moved downwardly from the position shown in FIG. 1, the engagement between the cam 30 and shoulder 35 remains axially fixed while the cam 32 pushes pad 22 downwardly and this moves pin 16 downwardly so that the cross pin 34 at the upper end of the pin will pull the collar 36 downwardly, the pin 34 being connected to the collar 36.

A plurality of dowel pins 50 are fixed in the collar 36 and are slidable in holes in the head 10 and project across the cross bore 52 in the head to capture the balls 54, 54 in the cross bore in contact with each other. The head is provided with a string receiving notch 56, the outer end of which is beveled at 68 to provide smooth exit for the string when it is released.

When the release is mounted on the bow string, the string lies in the bottom of the notch 56 and is kept therein by the balls 54, 54. As the trigger pulls the collar down, the dowel pins 50, 50 move downwardly relative to the balls and finally the balls are in position relative to the rounded ends 60 of the dowel pins to exert an increasing force component on the dowel pins 50. As soon as the force exerted on the dowel pins in this manner exceeds the force imparted to the pull pin by the spring 18, the force acting on the dowel pins will move the collar downwardly to move the dowel pins out of their restricting position and allow the balls 54, 54 to move apart until prevented from further outward movement by suitable coining of the cross bore or by partial closure of the cross bore 52 by the dowel pins. In the meantime, the balls will have separated enough to let the string out smoothly without biasing the string in either direction as it exits the notch. After the string is released and the trigger is released, the spring 18 moves the collar back to its original position and the balls 54, 54 move inwardly to close the notch.

It will be noted that the lower surface 62 of collar 36 will eventually strike the conical surface 64 on the spacer 46 and this will limit the downward movement of the collar and hence will limit the travel of the dowel pins downwardly. Thus the dowel pins can be prevented from moving so far down as to let the balls 54 out of the cross bore 52. And, this then means that it is unnecessary to take special steps in the cross bore 52 to prevent exit of the balls.

The rotatable spacer simply prevents the imposition of a restraining load on the head by the spacer 46. This prevents the archer's fingers from restraining free rotation of the head by letting the fingers lie on the spacer without transmitting a restraining force to the head. Therefore, the angle of the trigger and of the archer's hand can be freely selected for maximum comfort and effectiveness while leaving the head completely free to line the notch up in the same place as the bow string at full draw, thus optimizing the release characteristic.

Figure 2:
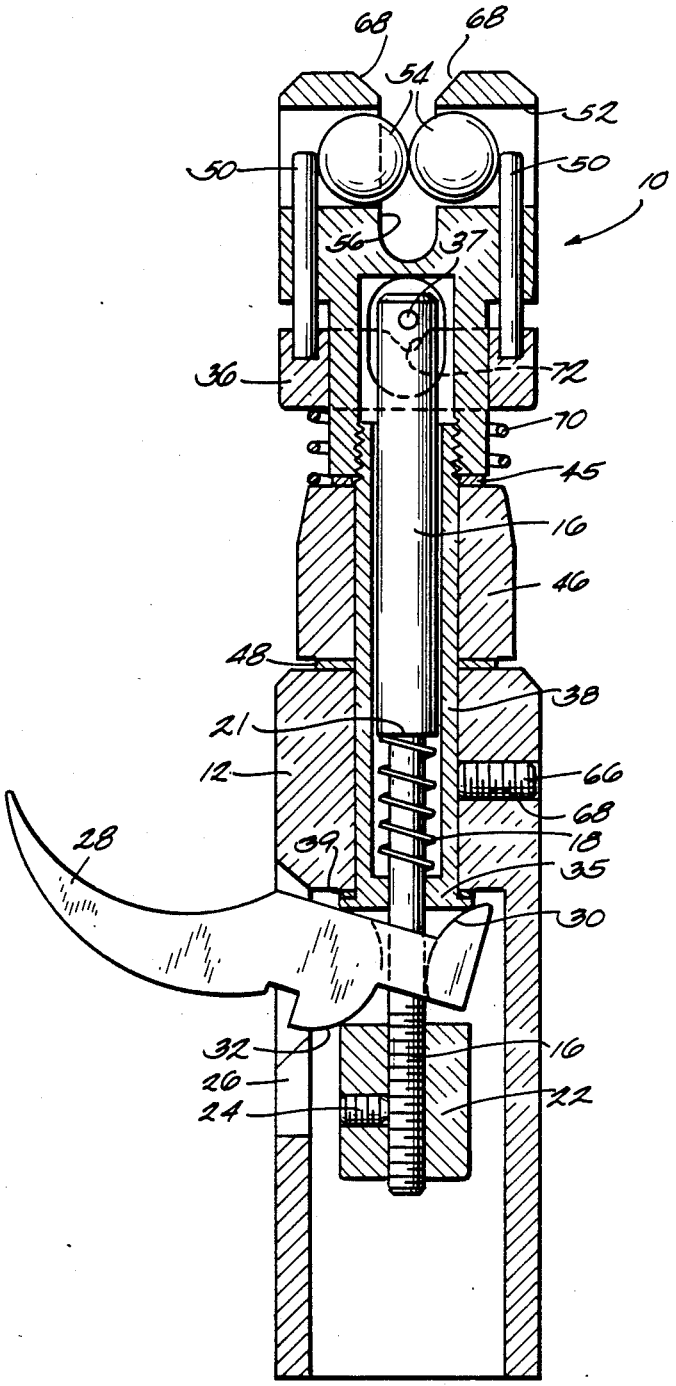
FIG. 2 is a vertical cross-section through a modified release.

In FIG. 2, parts similar to FIG. 1 bear similar numbers. The difference between these two designs resides essentially in the provision of the handle lock screw 66 in the threaded bore 68 in handle 12 to enable tightening this screw against sleeve 38 so as to prevent rotation of the handle relative to the sleeve 38 and, therefore, relative to the head 10. Some archers prefer a non-rotating design and this accommodates such wishes. Another difference is the provision of the return spring 70 between the spacer 46 and the collar 36. The idea here is to make the force of this spring somewhat less than the spring of the spring 18 biasing the pull pin inwardly. It will be noted that in this modification the pull pin is coupled to the collar through a one-way drive. Thus, the cross pin 35 in FIG. 2 is not connected directly to corresponding holes in the collar 36, but projects over the notch 72 in the collar. Thus, when the cross pin 35 is brought down into engagement with the collar 36, further downward movement of the pull pin picks up the collar and actuates the release. When the archer's finger is taken off the trigger, the spring 18 will push the pull pin back to whatever position the pad 22 permits. That is, it can travel upwardly above the position allowed by the coupler movement. At this point a gap appears as shown in FIG. 2. Now, when the trigger is actuated, this gap is first taken up, then the collar is moved down and the dowel pin starts moving down to the release position. At this point the return spring 70 can determine the force necessary for the string force acting to spread the balls to become great enough to cause release without any action or control by the archer. This is a good feature in that he does not know when he is about to trip it and therefore he must jet keep a nice pull on the trigger until the release takes place. He has no anticipatory flinch.

In both modifications the pad 22 can be screwed up and down to vary the position of the pull pin and therefore the travel of the trigger necessary to cause release. In the FIG. 1 position, adjustment of the pad 22 determines the stroke and may result in some gap before the cam picks up the pad and hence the pull pin during actuation of the release. In the FIG. 2 design the push pin will always move up until the pad engages the trigger cam 32 and this may result in a gap above the collar which gap must be taken up in order to start the release action.

With the foregoing limitations, it will be appreciated that these modifications are quite similar.

We claim:

1. A bow string release including, a handle, a head having a string receiving notch therein, means freely rotatably mounting said head on said handle, a collar slideably mounted on said head, a cross bore in said head intersecting said notch, a ball in said bore on each side of said notch, a pair of holes in said head parallel to and on opposite sides of said notch and intersecting said cross bore, a pair of pins each slidably mounted in one of said holes and fixed to said collar for movement between a first position in which said pins act on said balls to move said balls into contact closing said notch and a release position in which said balls are separated and a bow string can pass between the balls, a pull pin mounted on the axis of said head and connected to said collar and extending into said handle, said handle being rotatable relative to said pull pin, a trigger mounted in said handle and operative to actuate said pull pin to move said collar.

2. A bow string release according to claim 1 in which said trigger is pivoted in said handle, and said trigger is rotatable with said handle about the axis of said pull pin.

3. A bow string release according to claim 2 including means adjusting the length of the trigger stroke necessary to move said pair of pins to effect release of said bow string.

4. A bow string release according to claim 1 including means for adjusting the length of trigger stroke required to move said pair of pins to said release position.

5. A bow string release including, a handle, a head, a guide sleeve mounted in said handle and connected to said head, said sleeve having a shoulder engaging said handle, a thrust washer between said shoulder and said handle to permit free relative rotation of said handle with respect to said head, a string receiving notch in said head, a transverse cross bore in said head intersecting said notch, a ball in said bore on each side of said notch, a pair of holes in said head parallel to and on opposite sides of said notch and intersecting said cross bore, a collar mounted for axial slidable movement on said head, a pair of ball control pins fixed to said collar with each pin slideable in one of said holes in said head and intersecting said bore on the side of each ball remote from said notch to force the balls into engagement with each other in a first position to capture a bow string in said notch and to allow the balls to move apart to a release position in which said string is released, a pull pin slideably mounted in said sleeve and connected to said collar, spring means biasing said pull pin to move said collar to move said balls to said first position, and a trigger pivoted in said handle and connected to said pull pin.

6. A string release according to claim 5 in which said pull pin is rotatable with respect to said trigger.

7. A bow string release according to claim 6 including means for adjusting the pivotal movement required of said trigger to move said ball control pins to said release position.

8. A bow string release including, a handle having a hole therethrough, a head including a guide sleeve mounted in said hole in said handle, said sleeve having a shoulder spaced from said head engaging said handle to permit relative rotation of said handle with respect to said head and said sleeve, a string receiving notch in said head, a transverse cross bore in said head intersecting said notch, a ball in said bore on each side of said notch, a pair of holes in said head parallel to and on opposite sides of said notch and intersecting said cross bore, a collar mounted for axial slideable movement on said head, a pair of ball control pins fixed to said collar with each pin slideable in one of said holes in said head and intersecting said bore on the side of each ball remote from said notch to force the balls into engagement with each other in a first position to capture a bow string in said notch and to allow the balls to move apart to a release position in which said string is released, a pull pin slideably mounted in said sleeve and operative to actuate said collar, spring means biasing said pull pin to move said collar to move said balls to said first position and a trigger pivoted in said handle and connected to said pull pin.

9. A release according to claim 8 in which said pull pin has a one-way driving coupling connection to said collar and said collar can move pair of control pins independently of movement of said pull pin, second spring means acting on said collar to force said balls to said first position, the force of said second spring means being low so the force component imposed on said control pins by said balls as a tensioned bow string moves between the balls overcomes said second spring and moves the control pins to said second position independently of movement of said pull pin.

* * * * *

UNITED STATES PATENT AND TRADEMARK OFFICE

CERTIFICATE OF CORRECTION

PATENT NO. : 4,926,835

DATED : May 22, 1990

INVENTOR(S) : Paul L. Peck

It is certified that error appears in the above-identified patent and that said Letters Patent is hereby corrected as shown below:

Col. 1, line 16, delete "Release" and substitute therefore -- Releases --.

Col. 3, line 9, delete "inwardly" and substitute therefore -- upwardly --.

Col. 3, line 31, delete "jet" and substitute therefore -- just --.

Col. 4, claim 6, line 1, after "A" insert --bow--.

Signed and Sealed this

Eighteenth Day of June, 1991

*Attest:*

*Attesting Officer*

HARRY F. MANBECK, JR.

*Commissioner of Patents and Trademarks*